US005947840A

United States Patent [19]

Ryan

[11] Patent Number: 5,947,840

[45] Date of Patent: Sep. 7, 1999

[54] ADJUSTABLE WEIGHT GOLF CLUB

[76] Inventor: William H. Ryan, 101 Delafield Ave., Staten Island, N.Y. 10301

[21] Appl. No.: 08/899,939

[22] Filed: Jul. 24, 1997

[51] Int. Cl.[6] ..... A63B 53/04

[52] U.S. Cl. ..... 473/335; 473/349

[58] Field of Search ..... 473/324, 334, 473/335, 336, 337, 338, 339, 341, 345, 349, 291, 282

[56] References Cited

U.S. PATENT DOCUMENTS

| | | | |
|---|---|---|---|
| 1,133,129 | 3/1915 | Govan | 473/337 |
| 2,056,335 | 10/1936 | Wettlaufer et al. . | |
| 3,059,976 | 10/1962 | Johnstone et al. . | |
| 3,652,094 | 3/1972 | Glover | 473/338 |
| 3,995,865 | 12/1976 | Cochran et al. | 473/337 |
| 4,010,958 | 3/1977 | Long | 473/341 |
| 4,607,846 | 8/1986 | Perkins | 473/336 |
| 4,867,458 | 9/1989 | Sumikawa | 473/336 |
| 4,869,507 | 9/1989 | Sahm | 473/337 |
| 4,872,684 | 10/1989 | Dippel | 473/336 |
| 5,013,041 | 5/1991 | Sun et al. . | |
| 5,050,879 | 9/1991 | Sun et al. . | |
| 5,447,309 | 9/1995 | Vincent | 473/335 |
| 5,570,886 | 11/1996 | Rigal | 473/335 |

*Primary Examiner*—Sebastiano Passaniti
*Attorney, Agent, or Firm*—Dechert Price & Rhoads

[57] ABSTRACT

The present invention provides for golf clubs, in particular woods, which include a three dimensional weighting system including at least two weight ports which are attached to the outside of the clubhead. The weights are directly axially aligned to, and form an equilateral triangle with the clubs center of gravity. The weights are preferably located in close proximity to the sole plate of the club in the rear toe and heel position. The two double sided, from top to bottom weights, facilitate vertical, horizontal and lateral movement of the club's center of gravity. The weights are made of various densities which can easily be interchanged to make the club lighter or heavier. This weighting system allows for individual customization of the club to increase or decrease the hooking or slicing of the ball. It also enables the club to have the greatest possible expansion of the moment of inertia, as well as the ability to lower or raise the clubs center of gravity to customize shot trajectory.

17 Claims, 4 Drawing Sheets

FIG. 1
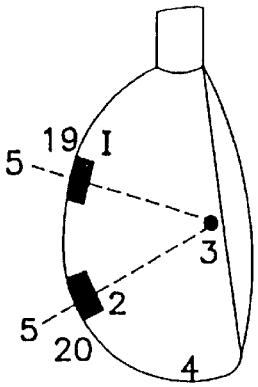
FIG. 2
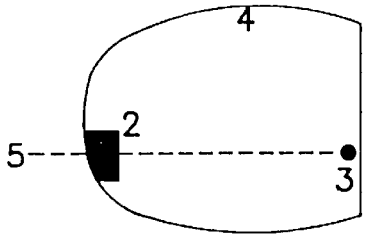
FIG. 3
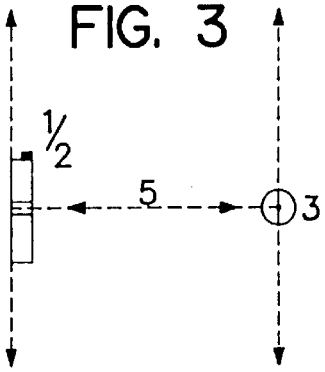
FIG. 5
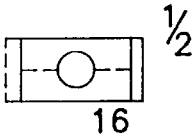
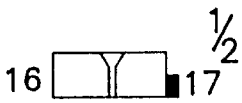
FIG. 5A
FIG. 6
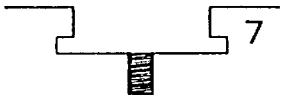
FIG. 6A
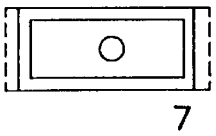
FIG. 4
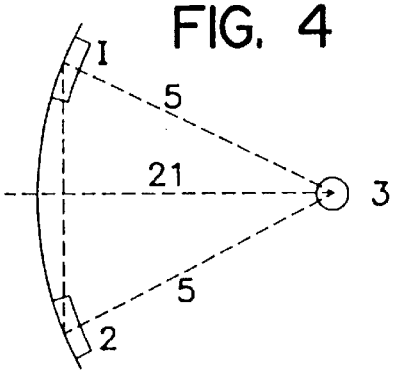
FIG. 7
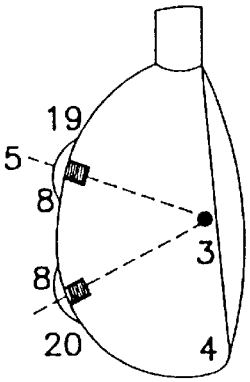
FIG. 8
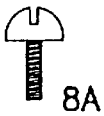
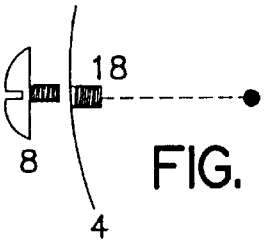
FIG. 9

HEAVY

LIGHT

EACH APROX..25" OFF CENTER CIRCLE RESULTS IN A 10 YARD LOSS OF DISTANCE

LOSS OF DISTANCE ON OFF CENTER HITS (10 YARDS ON EACH CIRCLE)

FIG. 18
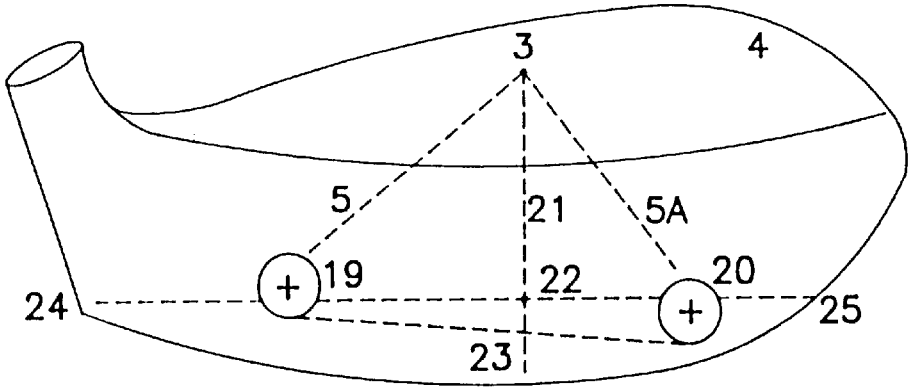
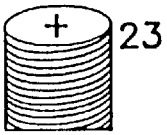
FIG. 19
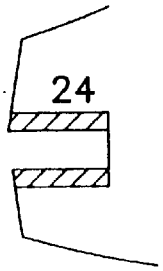
FIG. 20
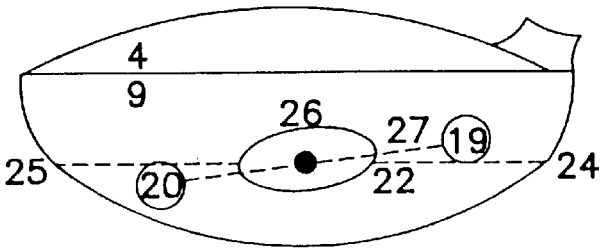
FIG. 21

ADJUSTABLE WEIGHT GOLF CLUB

BACKGROUND OF INVENTION

The present invention relates to golf equipment, in particular golf clubs, and more particularly still woods, which because of their extra length and reduced loft are usually the most difficult clubs for a golfer to make consistent center contact with.

Experienced golf professionals and occasional-playing amateurs alike would probably agree that the current state of golf technology makes the sport too difficult. With the average player shooting over 105 and with less than 2% of all golfers consistently able to break 80, the game needs to be made easier. Golf's difficulty is partly inherent in the complexities of the game itself and partially due to the golfer's inability to master unforgiving clubs that are not designed specifically to an individual's strength and swing tendencies.

Golf clubs, even if they are custom-made for the individual player, have little versatility once assembled. Neither the weight of the club heads, the shot trajectory nor the applying or reducing of side spin can be adjusted as the golfer ages or improves. The present invention solves this problem. Moreover, because the weighting means is adjustable within the particular club, even those that are custom-made, the club can be adjusted from round-to-round or golfer-to-golfer. The present invention solves all of the problems mentioned above, as well as significantly improving upon the prior art.

SUMMARY OF INVENTION

The present invention is directed to an improved golf club in which the clubhead is provided with adjustable weight means. These adjustable weight means allow an individual golfer to alter the clubhead's center of gravity. More particularly, the adjustable weight means of the present invention allows for adjustments to the center of gravity in three dimensions, as contrasted with prior art weights, which only provide for limited adjustment in one or two dimensions.

By providing a means for adjusting the center of gravity, the golfer can effectively tailor or design clubs which will minimize torque effects resulting from striking the ball at points other than the center of gravity, thereby causing off-center shots to have a more solid feel, with less ball flight curvatures and less loss of distance. The consequences are an improved swing, better ball contact and more accurate shots.

The "sweet spot" of a golf club may be defined as the point of maximum energy transference during the impact of the clubhead with the ball. This is usually the point at which a line perpendicular to the club face passes through the center of gravity. If a ball which is hit on the club face is hit only approximately 0.25 inch off of the sweet spot, the shot which is produced will ordinarily result in a 10 to 12 yard loss of distance and an adverse side spin imparted to the ball.

As stated above, the general effect of altering the center of gravity of golf club heads is known in the art. See for example: U.S. Pat. No. 2,056,335, Wettlaufer and U.S. Pat. No. 3,059,976, Johnstone. However, even in the closest prior art, the ability to expand the moment of inertia is limited to two dimensions.

For example, in U.S. Pat. Nos. 5,050,879 and 5,013,041, both Sun, et al., the inventors have designed club heads to move the center of gravity horizontally and vertically along the front of the club near the club face. However, the distance between the weights and the clubhead's center of gravity can be no more than one inch. The present invention positions the weights at least 1.2 inches further away, thereby allowing for an expansion of the sweet spot to more than double the size of the prior art. Similarly, in U.S. Pat. No. 4,869,507, Sahm, the moment of inertia can be expanded laterally and horizontally, but not vertically.

Furthermore, none of the adjustable-weight clubs of the prior art position the weights in axial alignment or on the same latitude as the club's center of gravity. This omission tends to lead to clubs which are prone to produce an unbalanced, wobbling motion during the swing, and resulting in a stroke which is inconsistent and error-prone. The present invention, conversely, positions the weights in three-dimensional axial alignment with the natural center of gravity of the club.

Additionally, in prior art clubs, the weights and weight ports are often recessed through the perimeter of the clubhead into the club cavity. For example, see FIGS. 11 and 12 of '507, Sahm, in which the weight ports are recessed into the clubhead by at least three quarters of an inch. This placement of the weights into the club cavity further reduces the expansion of the moment of inertia or "sweet spot". It also weakens the wall strength of the club and its solidness. By contrast, the present invention provides for weight ports on the outer perimeter of the clubhead.

Lastly, none of the prior art clubs provide for weights having variably weighted sides or portions within an individual weight. This variable "weighting within a weight" provides even greater adjustability over the prior art and within the three dimensions.

DESCRIPTION OF DRAWINGS

FIG. 1 is a cutaway top interior view of the of the clubhead.

FIG. 2 is a cutaway side interior view of the clubhead.

FIG. 3 is a side view of the weights ports on the same longitudinal and vertical plane as the center of gravity.

FIG. 4 is a top view of the weight ports and center of gravity forming an equilateral triangle.

FIG. 5 is a top view of an individual weight means

FIG. 5*a* is a side view of an individual weight means.

FIG. 6 is a side view of a weight port.

FIG. 6*a* is a top view of a weight port.

FIG. 7 is a top cross-sectional view of a clubhead, with alternative weight means attached.

FIG. 8 is a side view of an alternative weight means.

FIG. 9 is a side view of an alternative weight port configuration.

FIG. 18 is a rear view of the clubhead, showing another alternative weight port means.

FIG. 19 is a side view of an alternative weight means.

FIG. 20 is a side, cross-sectional view of a portion of a clubhead showing an alternative weight means configuration.

FIG. 21 is a cross-sectional view of a clubhead from the front of the clubface, showing alternative weight means positions.

DETAILED DESCRIPTION OF THE INVENTION

Figure 10:
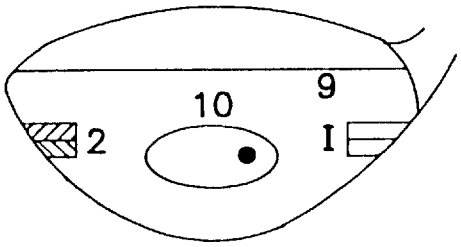
FIGS. 10–15 are cross-section views of a clubhead, showing various positions of the weights, as seen from the face of the clubhead.

The present invention provides for golf clubs, in particular woods, which contain a three-dimensionally-adjustable weighting system. The weighting system includes one or more weight ports or chambers, preferably a plurality, which are located on the exterior of the clubhead, preferably proximate to the toe and heel of the individual club, and the weights themselves. The weights are positioned to be axially aligned, and, when there is a plurality of them, generally form an equilateral triangle with the normal center of gravity of the club. Preferably, the weights are two-sided, in which the individual weight on each side of the whole weight is the same or different from the weight of the other side of the whole weight. In a preferred embodiment, the weights, and more particularly the individual sides of the two-sided weights, are composed of materials of various densities and can easily be interchanged to make the club lighter or heavier, and vary the weight relative to the center of gravity. The two sides of the weight may be characterized as relative to or around the central axis of the weight, i.e. "above" or "below" the axis, so that when the weights are adjusted on the surface of the clubhead, the center of gravity is adjusted higher or lower on the clubhead as function of that two-sided configuration. This would contrast with prior art embodiments, such as Govan, U.S. Pat. No. 1,133,129, in which the density of the weight may be seen as varying along the axis of weight, as opposed to around it.

This weighting system, and in particular the two-sided weighting of the individual weights, greatly facilitates the vertical, horizontal and lateral adjustment of the center of gravity of the clubhead, thereby providing for individual customization of the club. This enables the golfer to decrease errors in the golf shot, for example, hooking or slicing of the ball. It also enables the club to have the greatest possible expansion of the moment of inertia, as well as the ability to lower or raise the center of gravity of a club to customize shot trajectory.

The weight chambers or ports are preferably positioned relative to or aligned within the club so that the center of each port, and therefore each weight, is aligned with the club's center of gravity, i.e. the top half of the weight is above the center of gravity and the bottom half is below. This allows for maximum stability during the swing of the club, while also maximizing possible trajectory changes.

In a preferred embodiment, the clubhead of the invention would include four sets of identical double-sided weights. These preferred weights comprise top to bottom halves of different materials fused together to form one solid weight. One set of weights comprise lighter weight materials on both halves. A second set of weights will consist of heavier materials on both halves, while the third set of weights comprises a lightweight material on one half and a heavy-weight material on the other half. The fourth set of weights will consist of a lightweight material on one half and a medium weight material on the other half, relative to the weight of the lighter and heavier weight materials.

The exact weight of each individual weight can be changed to accommodate different size and weight drivers and fairway woods. The preferred embodiment described above, for example, allows for 64 different weight placement combinations. The type of weights, and their placement, can significantly vary the nature of the club and the resulting shot. By placing the heavier weights in the toe weight port and the lighter ones in the heel weight port, the hooking spin of a shot will be reduced or eliminated. By placing the heavier weights in the heel weight port and the lighter weight in the toe weight port, slicing spin will be reduced or eliminated. By placing the medium or heavy weight in both the heel and toe weight ports, the expansion of the moment of inertia will increase to its maximum for each respective mass.

By placing the lightest weights in both weight ports, the weight of the club will be reduced significantly allowing for more club head speed and longer distance. By placing the heavier half of the weight on the bottom the weight port or ports, the center of gravity will be lowered, producing a shot with a higher trajectory. By placing the lighter half of the weight on the bottom of the weight port or ports, the center of gravity will be raised producing a shot with a lower trajectory. These combinations of weights and their possible placements allow for a three dimensional customization of the club to fit the individual's needs.

In a preferred embodiment, imaginary lines drawn through the central axes of the weight positioning means, i.e. the weight ports, and by extension the weights themselves, are aligned in three dimensions with the center of gravity of said clubhead and intersect the normal center of gravity of the clubhead with the weights removed. The placing of the weight ports in these axes passing through the center of gravity of the clubhead greatly improves the major principal axis of inertia in the vertical direction. Nowhere in the prior art is it taught that this weight port placement will have such a synergistic effect with the clubhead's principal axis.

The club itself can be made from any conventional material used in the fabrication of golf clubs. In a preferred embodiment, the club heads are comprised of metal or wood, more preferably metal. A metal head can be made with any number of metals or metal alloys.

There is a wide variety of materials from which the weights can be made, so long as they are consistent with the types of materials generally used in golf club manufacture and can withstand the rigors of regular use. The weights can be comprised of metals, metal alloys, composite material, such as ceramic, graphite, polymer, and plastics, such as Kevlar, etc. In a preferred embodiment, the weights are comprised of metals having a variety of densities, including but not limited to aluminum, copper, stainless steel, and lead.

In order to fully explain and appreciate the advantage in the present invention, over the prior art in particular, the following calculations may be applied. Using this calculation, it is possible to derive a figure which represents the expansion of the center of gravity, and therefore the "sweet spot", using the adjusted weighting system of the present invention.

General Formula:

$$\text{Change in the Center of Gravity } (\Delta CG) = \frac{\text{Added Mass} \times \text{Distance from the } CG}{\text{Total Mass}}$$

Present Invention:

$$\Delta CG = \frac{\text{Added mass (30 grams)} \times \text{Distance (2.2 inches)} = .307''}{\text{Total Mass} = 215 \text{ grams}}$$

$\therefore$ Change or expansion of the $CG$ is .307″

Prior art (U.S. Pat. No. 4,869,507, Sahm):

$$\Delta CG = \frac{\text{Mass added (30 grams)} \times 1.55'' = .211''}{\text{Total mass} = 215 \text{ grams}}$$

$\therefore$ Change or expansion of the $CG$ is .211″

Using this calculation, the present invention yields an approximately 32% greater expansion of the center of gravity than the prior art. This results in an approximately equivalent improved capacity for adding to or reducing the side spin on the ball resulting from off-center hits, as well as a similarly improved travel distance.

DESCRIPTION OF A PREFERRED EMBODIMENT

Referring to the drawings, in FIG. 1, the weight chambers or ports [1], [2] are shown positioned in on the forward toe [20] and rear heel section [19] of the club head [4]. The weight chambers are axially aligned with the club's center of gravity [3]. As shown in FIG. 2, the weights ports and weight centers are also vertically aligned [5] with the club's center of gravity [3].

In FIG. 3, the center of the weights [1] and [2] are axially aligned [5] with the center of gravity of the clubhead [3] in the vertical plane.

As shown in FIG. 4, the center of the weights [1] and [2], are axially aligned [5] with the center of gravity of the club [3], and the weights are spaced equally apart from an imaginary center line [21], forming an equilateral triangle with the club's center of gravity.

As shown in FIG. 5, the weights themselves [16] comprise two substantially equal-sized weight halves, preferably fused together. They may be of similar or different densities and are capable of being rotated from top to bottom within the weight ports [1], [2]. As further shown in FIGS. 5*a* and 6*a*, the weights preferably have a notch on one side [17], which is intended to fit into either one of the weight ports [7], facilitating the improved securing of the weights within the weight ports. The weights may be secured into the weight ports [7] by any conventional means, preferably a screw device [6]. The weights may also be more permanently secured by use of epoxy or other adhesives, although this limits the ability to adjust the weights after they have been secured.

FIG. 7 shows an alternative embodiment of the same clubhead [4] in which another embodiment of the weights is shown. These alternative weights [8] and the weight chambers or ports [18] are also directly aligned [5] to the club's center of gravity [3].

FIG. 8 illustrates an alternative weight means, which comprises identically-sizes rounded halves. The weights themselves [8] have a screw means attached to the bottom of each individual weight [8*a*] for securing it into the weight port.

FIG. 9 illustrates how the alternative weights [8] appear when attached into the outside perimeter of the club [4] via the alternative weight chamber or port [18]. They are aligned so that one half of the weight would preferably be above the club's center of gravity [3] and the other half would be below.

Figure 11:
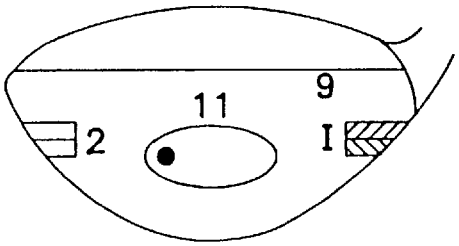
Figure 12:
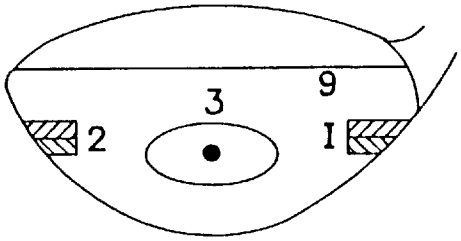

FIGS. 10–15 all show how the club's centers of gravity may be expanded using the weight system of the present invention. In FIG. 10, the gravity would be expanded [10] towards the weight in the toe of the club [2]. This configuration helps to reduce or eliminate any hook spin on the ball. FIG. 11 shows the club's center of gravity [3] expanded [11] towards the weight in the heel of the club [1]. This configuration helps to reduce or eliminate any slice spin on the ball. FIG. 12 shows the club's center of gravity configuration would give the maximum expansion of the sweat spot for solidness, distance, with the least amount of curvature imparted to the ball on off center hits.

Figure 13:
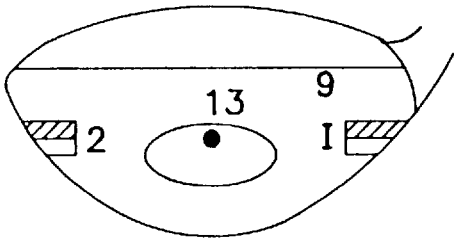

FIG. 13 shows the club's center of gravity expanded towards the toe [2] and heel weights [1], as well as in an upward vertical direction [13], because the heavier weights are placed in the upper half of the weight above the club's center of gravity [3]. This configuration yields excellent center of gravity expansion for off-center hits, as well as raising the club's center of gravity producing a lower shot trajectory.

Figure 14:
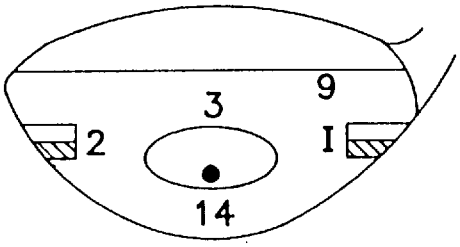

FIG. 14 shows the club's center of gravity expanded towards the toe [2] and heel weights [1], as well as in a downward vertical direction [14], because the heavier weights are placed in the lower half of the weight port below the club's center of gravity [3]. This configuration provides excellent center of gravity expansion for off center hits as well as to lower the club's center of gravity producing a higher shot trajectory.

Figure 15:
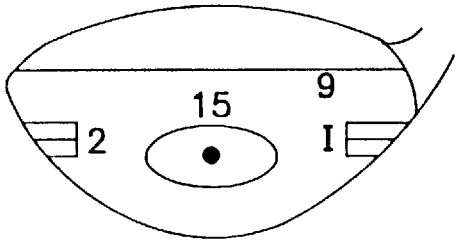
Figure 15:
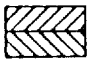
Figure 15:
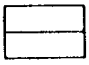

FIG. 15 shows the club's center of gravity [3] expanded towards the toe [2] and heel [1] of the club [15]. This configuration would give the lease amount of center of gravity expansion but it would make the club head considerably lighter, enabling the golfer to produce maximum clubhead speed for more distance.

Figure 16:
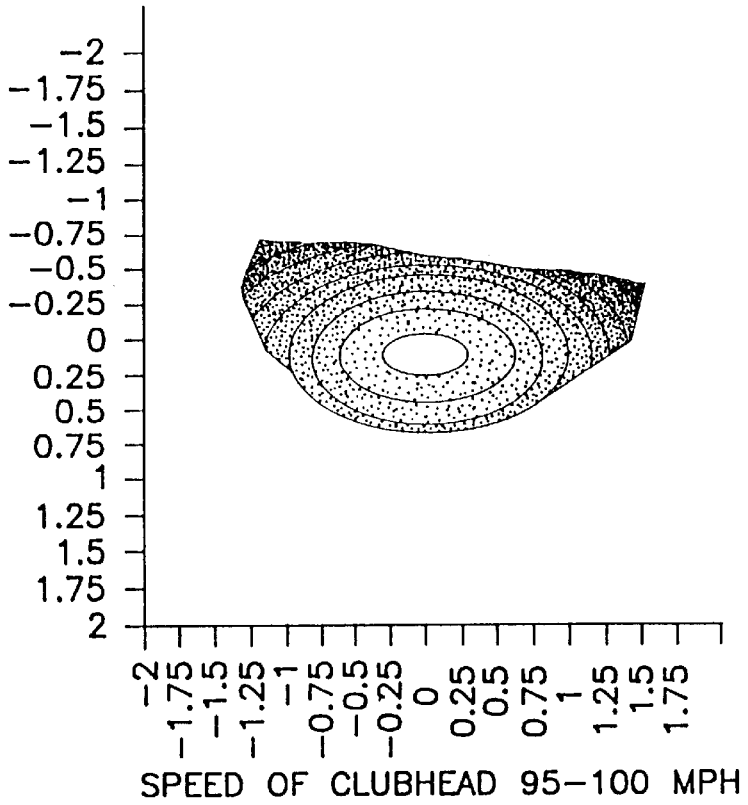
FIG. 16 is a graph of a cross-sectional view of a clubface, showing impact rings.

FIG. 16 illustrates consecutive elliptical shaped configurations superimposed upon the clubface. This pattern would occur with clubhead speeds of 95 to 100 mph. The graph lines are approximately 0.25 of an inch apart; therefore, the impact of each 0.25 of an inch off center translates into an approximate 10–12 yards loss of distance.

Figure 17:
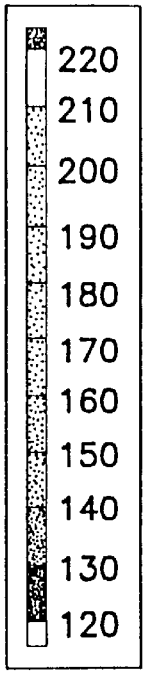
FIG. 17 is a vertical scale of distance losses caused by off-center impacts to the clubface.

FIG. 17 is a vertical chart which illustrates the distance the ball would travel on center and off center hits at 95 to 100 mph. As can be seen, there is a 10 yard loss of distance on each successive ellipse.

FIG. 18 illustrates another alternate and embodiment of the clubhead [4]. The weights [19] and [20] are aligned with the club's center of gravity [3] on a tilted plane [5], [5*a*] and [23]. The heel weight [19] would be positioned above the club's vertical center of gravity plane [22]. This would raise the club's center of gravity in a heelward direction [24], thereby producing a lower trajectory in the flight path of a ball struck more towards the heelward side of the clubface. The toe weights [20] would be positioned below the club's vertical center of gravity plane [22]. This would lower the club's center of gravity in the toeward direction [25], thereby producing a higher trajectory in the flight path of a ball struck towards the toeward side of the clubface.

FIG. 19 shows an additional alternative embodiment of a fastening means for the weights. Specifically shown are cylindrical weights having a screw-face surface, permitting the weights themselves to be directly fastened into the weight ports by screwing. The weights may be constructed in various lengths [23], [24] and various densities in order to facilitate the adjustments described elsewhere herein.

FIG. 20 illustrates another alternative weight port embodiment [24]. In this embodiment, the weights [23] are affixed into the weight port, preferably by screwing, until they are flush with the clubhead. [4].

FIG. 21 illustrates how the center of gravity of the clubhead would be expanded on a tilted plane [27] towards the added weights when using the present invention. This helps to lower the trajectory of a ball which is struck towards the heel of the clubface [24], a circumstance which would normally cause the ball's trajectory to be abnormally high, and also raises the trajectory of a ball which is struck towards the toe of the clubface [25], a circumstance which normally causes the ball's trajectory to be abnormally low.

Numerous variations or modifications of this invention, all within the scope of the invention, will readily occur to those skilled in the art. All such modifications and variations are considered to be within the scope this invention. Accordingly, the foregoing detailed description is but one variation of the invention used to demonstrate the principals for the invention and the invention is not limited thereto. The scope of this invention is to be determined solely by the claims included herein.

What is claimed is:

1. A golf club head, comprising a three-dimensionally-adjustable weighting system with means for adjusting the position of weight within said club head, wherein said weight positioning means are positioned within said club head so that an imaginary line drawn along a central axis of each of said weight positioning means is aligned with and intersects the center of gravity of said club head with the weight positioning means removed.

2. The golf club as claimed in claim 1, wherein said clubhead comprises a plurality of weight positioning means, wherein at least one of said weight positioning means is positioned towards a toe end of said clubhead and at least one of said weight positioning means is positioned towards a heel end of said clubhead.

3. A golf club head provided with means for adjusting the position of weight within said club head, wherein said weight positioning means are positioned within said club head so that an imaginary line drawn alone a central axis of each said weight positioning means is aligned with and intersects the center of gravity of said club head with the weight positioning means removed, wherein said weight positioning means comprises one or more two-sided weights, each side of said weights being defined relative to a central axis of said weight positioning means, wherein the individual weight of each side of said two-sided weights is the same or different from the weight of the other side of said two-sided weight.

4. The golf club head as claimed in claim 3, wherein one side of each of said two-sided weights has a different mass than the other side.

5. The golf club as claimed in claim 4, wherein each of the sides of said two-sided weights is comprised of a material of a different density.

6. The golf club as claimed in claim 5, wherein said material is metal or a metal alloy.

7. The golf club head as claimed in claim 3, wherein said two-sided weights are configured to permit adjustable alignment of said two-sided weights within said club head, thereby facilitating the adjustment of the overall weight distribution within said club head.

8. The golf club head as claimed in claim 7, wherein the two-sided weights comprise a light weight side and a heavy weight side and wherein the two-sided weights are aligned so that the heavy weight sides are above the center of gravity of said club head 1.

9. The golf club head as claimed in claim 7, wherein the two-sided weights comprise a light weight side and a heavy weight side and wherein the two-sided weights are aligned so that the heavy weight sides are below the center of gravity of said club head.

10. The golf club head as claimed in claim 7, wherein said weight positioning means are maintained within chambers formed within the body of said club head and held in position within said chambers by securing means.

11. The golf club head as claimed in claim 10, wherein said securing means pass through the center of said two-sided weight and are aligned with the center of gravity of said club head.

12. The golf club as claimed in claim 10, wherein said securing means are screwing means.

13. The golf club head as claimed in claim 7, wherein said weight positioning means are maintained on the outside of the body of said club head and held in position within chambers formed on the outside of the body by securing means.

14. The golf club as claimed in claim 13, wherein said two-side weights are generally circular in cross-section.

15. The golf club as claimed in claim 14, wherein each of the sides of said two-sided weights is comprised of a material independently selected from the group consisting of metal, metal alloys, composite, graphite, polymer, plastic, ceramic, Kevlar, or combinations thereof.

16. The golf club as claimed in claim 7, wherein said two-sided weights are generally square-shaped in cross-section.

17. A golf club head comprising a plurality of weight positioning means, wherein at least one of said weight positioning means is positioned towards a toe end of said club head and at least one of said weight positioning means is positioned towards a heel end of said club head, wherein the weight positioning means positioned towards the toe end is positioned below the center of gravity of said club head, and the weight positioning means positioned towards the heel end is positioned above the center of gravity of said club head.

* * * * *